US005126627A

United States Patent [19]

Itou et al.

[11] Patent Number: 5,126,627

[45] Date of Patent: Jun. 30, 1992

[54] COLOR CATHODE RAY TUBE INCLUDING A RED EMITTING PHOSPHOR AND A LIGHT FILTERING MEANS

[75] Inventors: Takeo Itou, Kumagaya; Hidemi Matsuda, Oomiya; Hajime Tanaka, Fujioka, all of Japan

[73] Assignee: Kabushiki Kaisha Toshiba, Kawasaki, Japan

[21] Appl. No.: 626,019

[22] Filed: Dec. 12, 1990

[30] Foreign Application Priority Data

Dec. 12, 1989 [JP] Japan ..... 1-320652

[51] Int. Cl.[5] ..... H01J 29/89

[52] U.S. Cl. ..... 313/478

[58] Field of Search ..... 313/478

[56] References Cited

U.S. PATENT DOCUMENTS

| | | | |
|---|---|---|---|
| 2,734,142 | 2/1956 | Barnes | 313/478 |
| 4,177,399 | 12/1979 | Muccigrosso et al. | 313/478 X |
| 4,604,550 | 8/1986 | Koesveld et al. | 313/478 |
| 4,987,338 | 1/1991 | Iou et al. | 313/478 |

FOREIGN PATENT DOCUMENTS

| | | | |
|---|---|---|---|
| 178024 | 4/1986 | Japan | 313/478 |
| 63-59505 | 11/1988 | Japan . | |

*Primary Examiner*—Palmer C. DeMeo

*Attorney, Agent, or Firm*—Cushman, Darby & Cushman

[57] ABSTRACT

A color cathode ray tube includes an envelope having, a faceplate, light filtering device provided on an outer surface of the faceplate, and a phosphor screen formed on an inner surface of the faceplate. The phosphor screen is composed of red, blue, and green emitting phosphors. The red emitting phosphor is primarily a $Y_2O_3$:Eu phosphor with an Eu activation amount between 3.0 mol % and 9.0 mol % inclusive with respect to a $Y_2O_3$ amount as a base material. The light filtering device is provided in front of the faceplate for selectively transmitting light having a maximum absorption wavelength of 575±20 nm in a wavelength range from 400 nm to 650 nm, and satisfies the following relationship: $T_{min} \leqq T_{550} \leqq T_{530}$, $1 \leqq T_{450}/T_{530} \leqq 2$, $1 \leqq T_{615}/T_{530} \leqq 2$, $0.7 \leqq T_{450}/T_{615} \leqq 1.43$, $T_{615}/T_{580-600} \geqq 1.1$, wherein $T_{450}$, $T_{530}$, $T_{505}$, $T_{615}$, $T_{min}$ and $T_{580-600}$ represent the transmissivities for lights of wavelength of 450 nm, 530 nm, 550 nm, 615 nm, the maximum absorption wavelength of 575±20 nm and a maximum absorption wavelength in a wavelength range of 580 nm to 600 nm, respectively.

8 Claims, 11 Drawing Sheets

COLOR CATHODE RAY TUBE INCLUDING A RED EMITTING PHOSPHOR AND A LIGHT FILTERING MEANS

BACKGROUND OF THE INVENTION

1. Field of the Invention

The present invention relates to a color cathode ray tube and, more particularly, to a color cathode ray tube with a thin film having light selectivity and on optical filter being formed on the front surface of a faceplate of the color cathode ray tube.

2. Description of the Related Art

In a color cathode ray tube, electron beams from an electron gun assembly arranged in a neck of an envelope are bombarded on a dot or stripe of red, green, and blue emitting phosphor layers regularly formed on the inner surface of the glass faceplate, thereby displaying characters and/or images.

A red emitting phosphor in this color cathode ray tube generally consists of europium-activated yttrium oxide ($Y_2O_3$:Eu) or europium-activated yttrium oxysulfide ($Y_2O_2S$:Eu). Although the $Y_2O_2S$:Eu phosphor can provide redness to some extent by color correction using an Eu activator concentration, sufficient brightness as a red pixel of a color cathode ray tube cannot be obtained.

Since the $Y_2O_2S$:Eu phosphor does not have satisfactory temperature characteristics, its brightness is lowered with an increase in temperature of a faceplate upon electron beam radiation. In order to explain this relationship, a relationship between the electron beam radiation time and the brightness of the red emitting phosphor is plotted in a graph of FIG. 1. As shown in FIG. 1, when an electron beam of 10.4 $\mu s/cm^2$ impinges on the $Y_2O_2S$:Eu phosphor, the brightness of the phosphor is lowered by about 8% in 120 sec. After a lapse of 120 sec. or more, the brightness is gradually lowered. The $Y_2O_2S$:Eu phosphor does not have satisfactory current-brightness characteristics. That is, when a current density is increased, a decrease in brightness tends to be increased. In particular, a red emitting phosphor has a higher current ratio than that of a blue or green emitting phosphor. Therefore, when the current-brightness characteristics of the red emitting phosphor are not sufficient, a serious problem is posed.

To the contrary, the $Y_2O_3$:Eu phosphor has a very high emission brightness level as compared with the $Y_2O_2S$:Eu phosphor and satisfactory temperature characteristics, as shown in FIG. 1. FIG. 2 is a graph showing a relationship between the current density and the relative brightness of the $Y_2O_3$:Eu phosphor for various Eu activation amounts when the brightness of the $Y_2O_2S$:Eu phosphor is given as 100%. As is apparent from FIG. 2, the relative brightness of the $Y_2O_3$:Eu phosphor as a function of an increase in current density is higher than that of the $Y_2O_2S$:Eu phosphor. Judging from this, it is understood that the $Y_2O_3$:Eu phosphor has satisfactory current-brightness characteristics. As shown in FIG. 2, even if an activation amount of Eu in the $Y_2O_3$:Eu phosphor is increased, brightness saturation rarely occurs. For this reason, the $Y_2O_3$:Eu phosphor has a higher brightness level in a large-current range, thus providing satisfactory phosphor properties. When an Eu activation amount is 4.5 mol% with respect to the base material, a practical color purity of a color cathode ray tube can be obtained. In this case, the $Y_2O_3$:Eu phosphor has a higher emission brightness level than that of the $Y_2O_2S$:Eu phosphor by +30%.

The Eu concentration is represented by an average molecular weight of the phosphor itself, i.e., {number of moles of $Eu_2O_3$ contained in 1 mol)×100} when it is figured out as an average molecular weight of a compound obtained by partially substituting Y of $Y_2O_3$ with Eu.

Along with the recent development of a larger color cathode ray tube, performance of an electron gun assembly for emitting electron beams, and particularly its focusing capacity has been improved. It is expected that the performance of the $Y_2O_3$:Eu phosphor on the phosphor screen can be improved by suppression of brightness saturation, and that the capability of the high-performance electron gun assembly can be maximized. However, even if an Eu activation amount of the $Y_2O_3$:Eu phosphor is increased, a sufficient color purity cannot be obtained as compared with the $Y_2O_2S$:Eu phosphor. FIGS. 3*a* and 3*b* show the chromaticity coordinate values (y and x values) and the Eu activation amount of the $Y_2O_3$:Eu phosphor, respectively. Ranges indicated by a hatched region in FIGS. 3*a* and 3*b*, i.e., ranges of $\times=0.620$ or more and $y=0.345$ or less, are practical chromaticity ranges of the $Y_2O_2S$:Eu phosphor. The corresponding Eu activation amount falls within the range of 3.0 mol% to 4.4 mol% with respect to the base material. As compared with the chromaticity ranges of the $Y_2O_2S$:Eu phoshpor, the chromaticity coordinate values of the $Y_2O_3$:Eu phosphor are $x=0.628$ and $y=0.347$, which are not practical. Even if an Eu activation amount is increased, changes in chromaticity are decreased with an increase in Eu concentration. Therefore, the y value as the chromaticity coordinate value does not reach the range represented by the hatched region. It is impossible to maintain image quality of the $Y_2O_3$:Eu phosphor to be equal to that of $Y_2O_2S$:Eu phosphor. A red emitting phosphor ideally has satisfactory brightness characteristics as those of the $Y_2O_3$:Eu phosphor and a satisfactory color purity as that of the $Y_2O_2S$:Eu phosphor at a low Eu activation amount.

In recent years, in order to improve color purity of a red emission component, suppress degradation of image brightness, and improve contrast, a color cathode ray tube having a neodymium oxide ($Nd_2O_3$)-containing glass plate to obtain a selective light-absorbing property formed on the front surface of a faceplate has been proposed (Published Unexamined Japanese Patent Application Nos. 57-134848, 57-134849, and 57-134850). This glass plate has a narrow main absorption band in a range of 560 to 615 nm and a sub absorption band in a range of 490 to 545 nm due to light-absorbing properties inherent to neodium oxide. Therefore, red and blue color purity values of an image can be advantageously increased.

Although this glass plate has selective light-absorbing properties, the contrast cannot be greatly improved. A method of evaluating an effect of contract improvement using BCP (Brightness Contrast Performance) is available. This BCP is defined as $BCP=\Delta B/\Delta Rf$ where $\Delta B$ is the brightness decrease rate and ARf is the rate of decrease in reflectance of ambient light. The BCP represents a contrast improvement ratio when a system using a neutral filter is assumed as a reference. When a neodium oxide filter having selective light-absorbing properties is evaluated by using the BCP, the BCP falls within the range of $1 \leqq BCP \leqq 1.05$. It is therefore understood that the contrast is not sufficiently improved Since the glass plate containing neodium in the main absorption band of 560 to 570 nm in a wavelength range of 560 to 615 nm, the color (body color) of the glass plate itself is changed by ambient light. In particular, the body color of the glass plate under an incandescent lamp becomes reddish. For this reason, a low-brightness portion such as a black or shadow portion in an image becomes reddish, readability is degraded, and image quality is degraded. In addition, since neodium is an expensive material, the resultant glass plate becomes expensive.

SUMMARY OF THE INVENTION

It is an object of the present invention to provide a color cathode ray tube having satisfactory red emission pixels, and satisfactory brightness, color purity, and contrast characteristics.

A color cathode ray tube according to the present invention comprises:

an envelope including a faceplate with an inner and outer surface, a side wall portion, a neck and a cone connecting the faceplate to the neck;

an electron gun provided inside the neck for emitting at least one electron beam;

a phosphor screen provided on the inner surface of the faceplate and consisting essentially of red, blue, and green emitting phosphors, the red emitting phosphor comprising a $Y_2O_3$:Eu phosphor with an Eu amount between 3.0 mol% and 9.0 mol% with respect to a $Y_2O_3$ amount as a base material; and light filtering means provided in front of the faceplate for selectively transmitting light, the light filtering means having the maximum absorption wavelength of 575±20 nm in wavelength range from 400 nm to 650 nm and satisfying the following relationship:

$$T_{min} \leqq T_{550} \leqq T_{530}$$
$$1 \leqq T_{450}/T_{530} \leqq 2$$
$$1 \leqq T_{615}/T_{530} \leqq 2$$
$$0.7 \leqq T_{450}/T_{615} \leqq 1.43$$
$$T_{615}/T_{580\text{-}600} \geqq 1.1$$

wherein $T_{450}$, $T_{530}$, $T_{550}$, $T_{615}$, $T_{min}$ and $T_{580\text{-}600}$ represent the transmissivities for lights of wavelength of 450 nm, 530 nm, 550 nm, 615 nm, the said maximum absorption wavelength in wavelength range of 575±20 nm and the maximum absorption wavelength in wavelength range of 580 nm to 600 nm, respectively.

According to the present invention, an optical filter having a predetermined selective light-absorbing property is combined with a $Y_2O_3$:Eu phosphor to obtain a color cathode ray tube exhibiting satisfactory color purity and brightness and having good red pixels.

A color cathode ray tube having a high contrast level and being capable of absorbing ambient light can be obtained by using this optical filter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The present invention will be described in detail with reference to the accompanying drawings.

Figure 1:
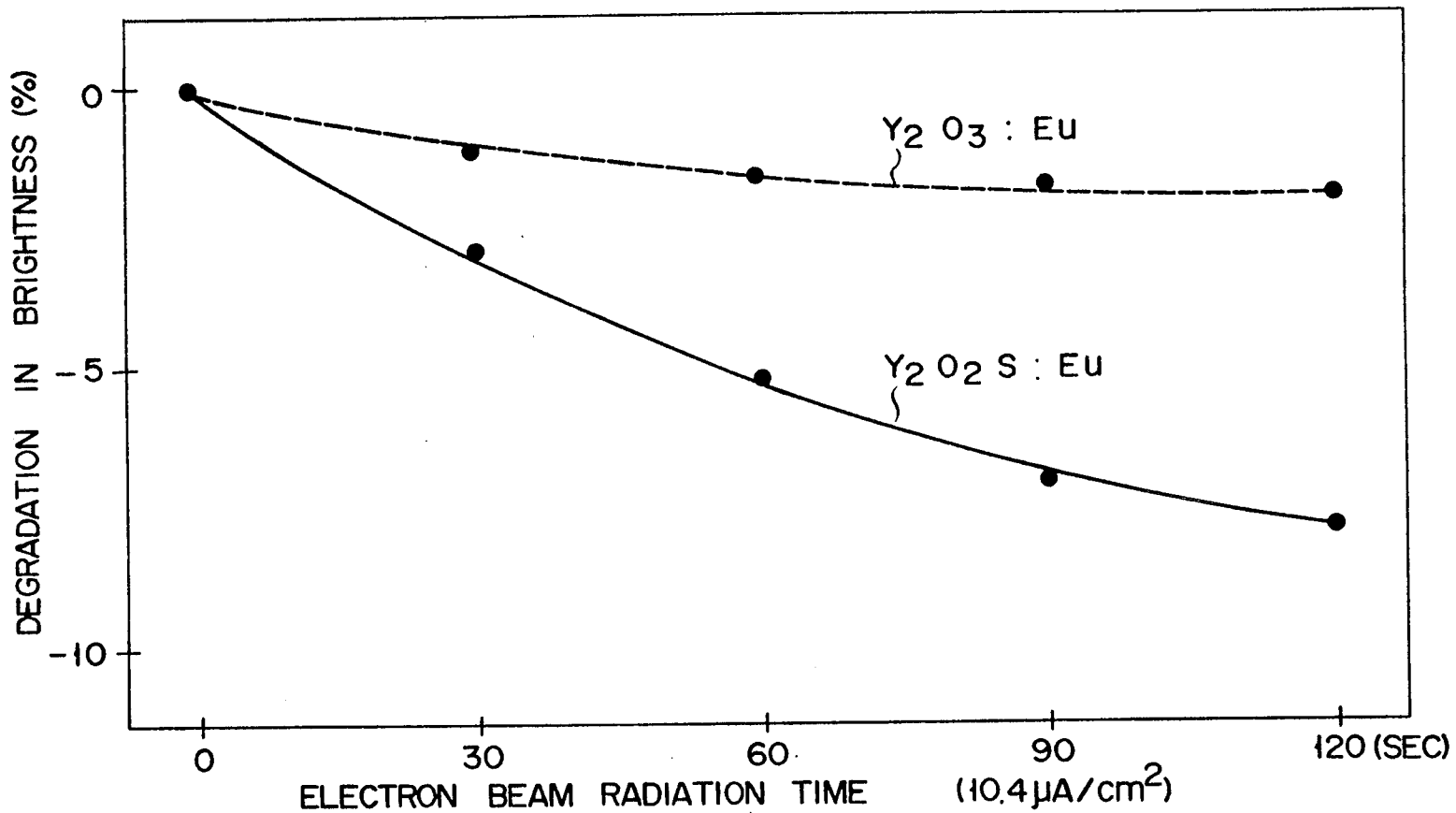
FIG. 1 is a showing a relationship between the electron beam radiation time and the brightness of a general red emitting phosphor.
Figure 2:
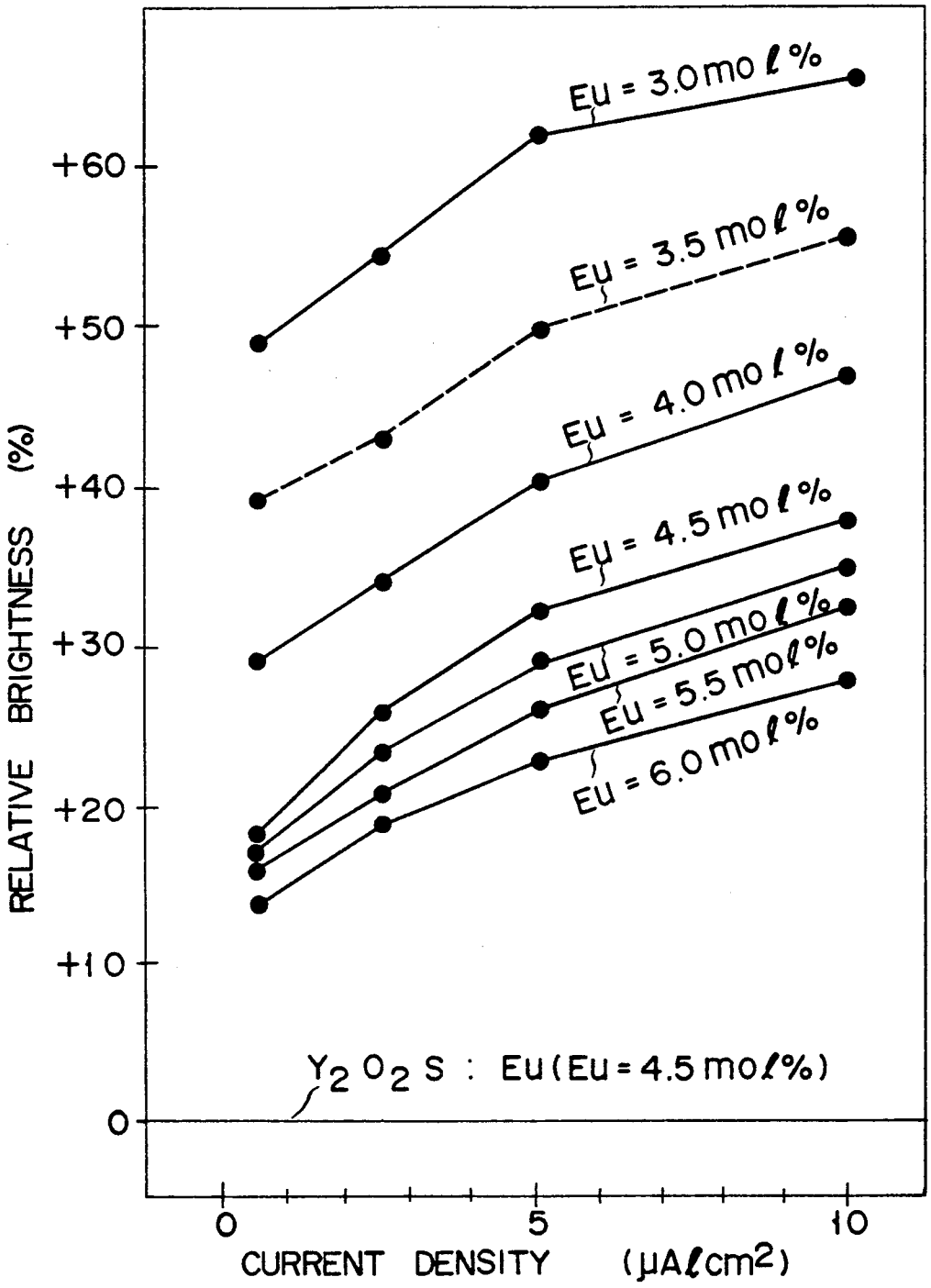
FIG. 2 is a graph showing current - brightness characteristics of $Y_2O_3$:Eu phosphor materials having different Eu activation amounts.
Figure 3A:
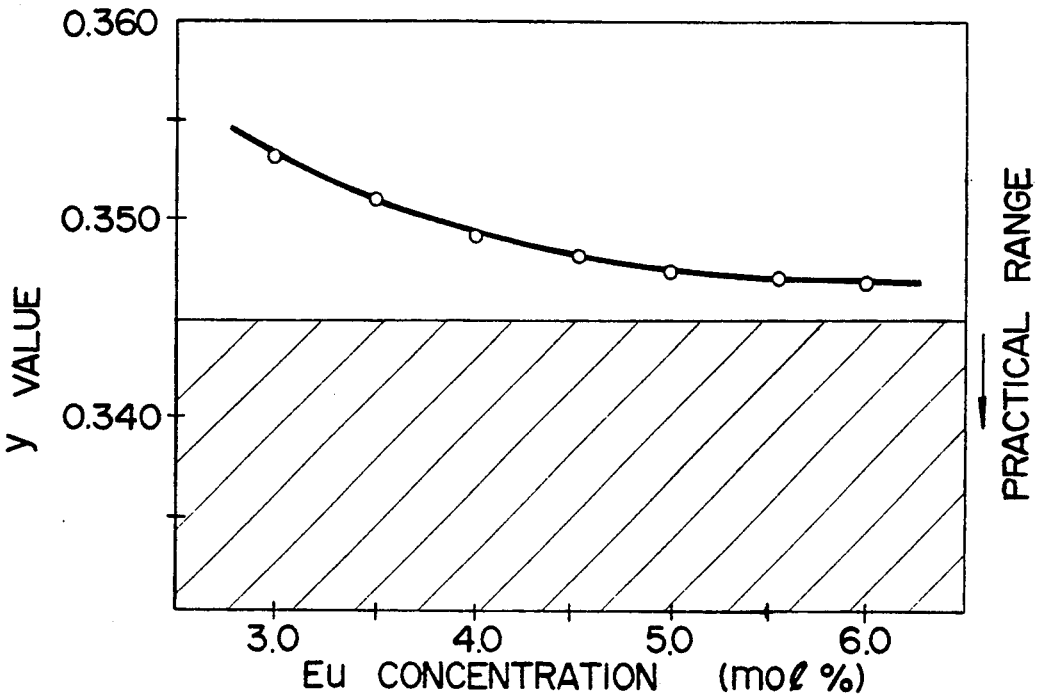
FIGS. 3A and 3B are graphs showing relationships between the Eu activation amounts of the $Y_2O_3$:Eu phosphor and the chromaticity coordinate values (y and x values), respectively.
Figure 4:
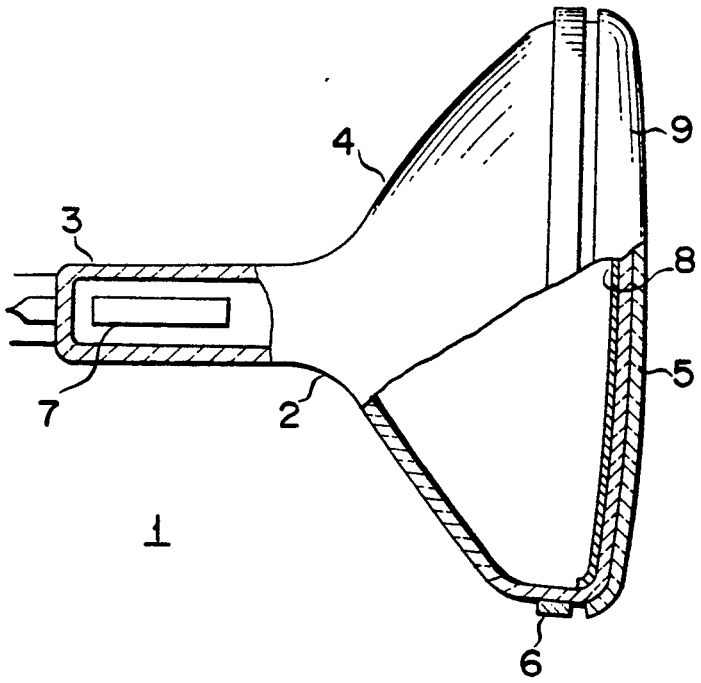
FIG. 4 is a partially cutaway view showing a cathode ray tube according to the present invention.
Figure 3B:
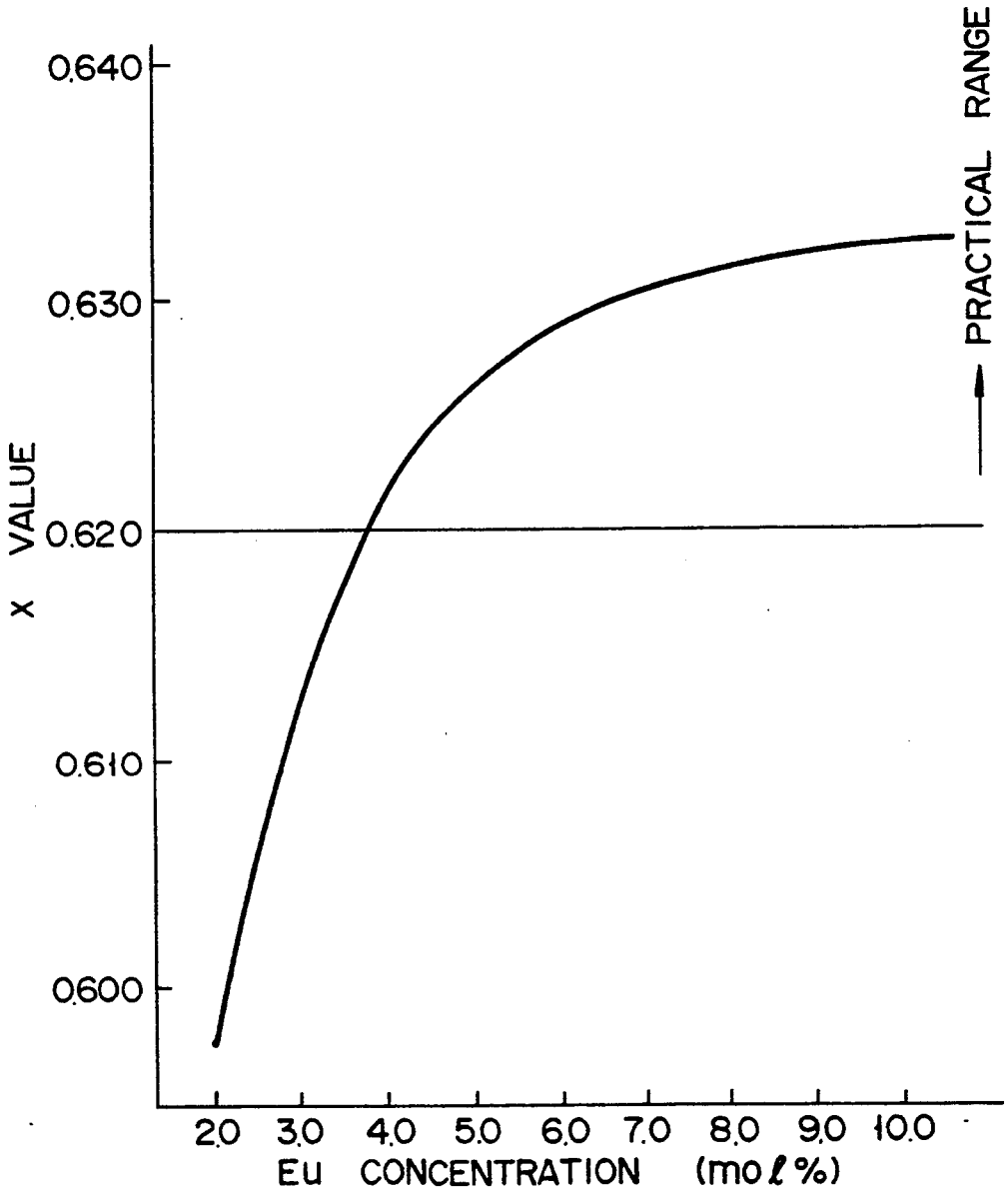

FIG. 4 is a partially cutaway side view showing a cathode ray tube according to the present invention. A cathode ray tube 1 has a glass vacuum tight envelope 2 having an evacuated interior. The vacuum envelope 2 has a neck 3 and a cone 4 continuous with the neck 3. The vacuum envelope 2 has a faceplate 5 tightly bonded to the cone 4 by fritted glass. A metal tension band 6 is wound around the outer circumferential wall of the faceplate 5 to prevent explosion. An electron gun assembly 7 is arranged in the neck 3 to emit electron beams. More specifically, the electron gun assembly 7 is arranged inside the faceplate 5. A phosphor screen 8 consisting of stripe-like phosphor layers for emitting red, green, and blue light components upon excitation by the electron beams emitted by the electron gun assembly 7 and of stripe-like black light-absorbing layers arranged between the phosphor layers is formed on the inner surface of the faceplate 5. A shadow mask (not shown) having apertures in its entire surface is arranged to closely oppose the phosphor screen 8. A deflection unit (not shown) is mounted on the outer surface of the cone 4 to deflect electron beams so as to scan the phosphor screen 8 with these beams.

Light filtering means 9 having a predetermined selective light-absorbing property is formed on the outer surface of the faceplate 5 in the cathode ray tube 1. An optical filter may be used as the light filtering means. A $Y_2O_3$:Eu phosphor having a predetermined Eu activation amount is used as a red emitting phosphor in the phosphor screen 8.

Light filtering means provided in front of the faceplate for selectively transmitting light, having the maximum absorption wavelength in wavelength range of 575±20 nm in connection with wavelength range from 400 nm to 650 nm and satisfying the following relationship:

$$T_{min} \leqq T_{550} \leqq T_{530}$$
$$1 \leqq T_{450}/T_{530} \leqq 2$$
$$1 \leqq T_{615}/T_{530} \leqq 2$$
$$0.7 \leqq T_{450}/T_{615} \leqq 1.43$$
$$T_{615}/T_{580-600} \geqq 1.1$$

wherein $T_{450}$, $T_{530}$, $T_{550}$, $T_{615}$, $T_{min}$ and $T_{580-600}$ represent the transmissivities for lights of wavelength of 450 nm, 530 nm, 550 nm, 615 nm, the said maximum absorption wavelength in wavelength range of 575±20 nm and the maximum absorption wavelength in wavelength range of 580 nm to 600 nm, respectively.

The relationship between the transmissivities will be described below.

Figure 5:
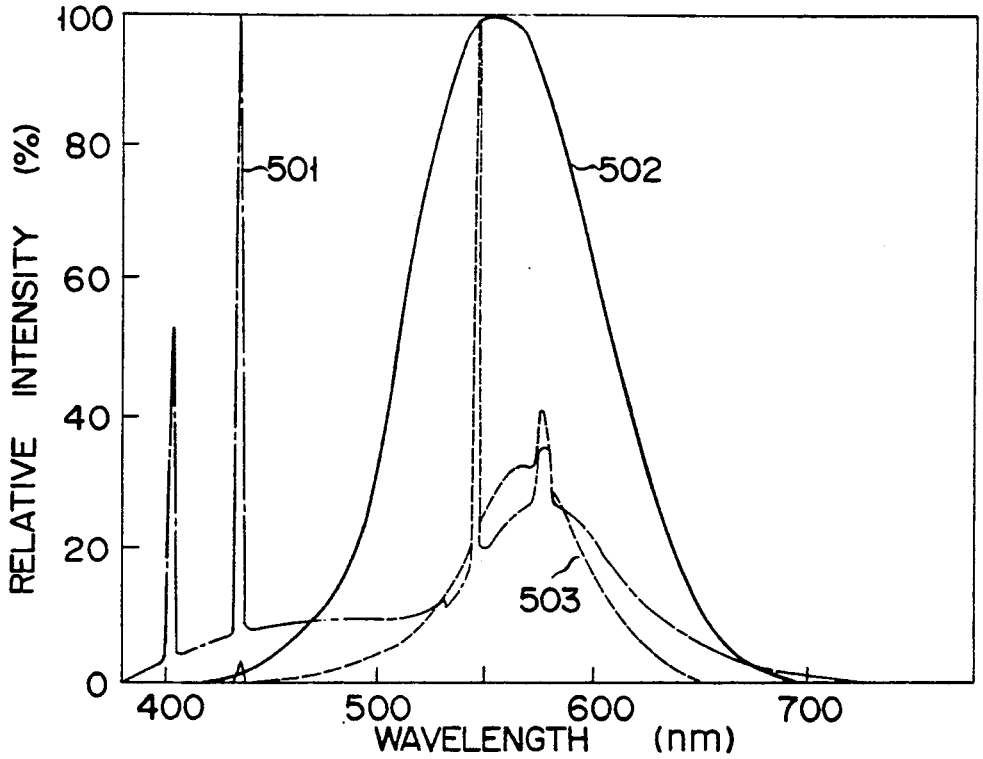
FIG. 5 is a graph showing a spectral distribution of light from a fluorescent lamp.

FIG. 5 shows a curve 501 representing a spectral distribution of light from a fluorescent lamp, a representing the product of the spectral distribution curve 501 and the spectral luminous efficacy curve 502. As is apparent from this graph, it is assumed that ambient light can be most efficiently absorbed by shielding light near the maximum value of the curve 503, i.e., light in the range of 575±20 nm. In this case, however, a decrease in brightness must be minimized. It is important to determine the characteristics of this optical filter in such a manner that the filter has a minimum luminous efficacy value, exhibits a maximum transmissivity and a maximum ambient light absorbance near 450 nm and 615 nm corresponding to a high emission energy of the phosphor, exhibits a minimum transmissivity near 575 nm corresponding to a low emission energy of the phosphor, and exhibits a medium transmissivity near 530 nm serving as an emission peak for a green emitting phosphor.

In addition, as the characteristics of the optical filter having the above transmissivities, between 575 nm and 530 nm, the transmissivity near 550 nm is smaller than that at 530 nm because an ambient light energy is higher and the emission energy of the green emitting phosphor is lower near 550 nm than those near 530 nm. More specifically, if a filter satisfying conditions $T_{min} \leqq T_{550} < T_{530}$ and $T_{530} \leqq T_{615}$ (where $T_{450}$, $T_{530}$, $T_{550}$, $T_{615}$, and $T_{min}$ are the transmissivities for the wavelengths of 450 nm, 530 nm, 550 nm, and 615 nm, and the maximum light-absorbing wavelength, respectively), maximum efficiency in improving the image contrast can be achieved.

Control of the body color of the optical filter was confirmed to be improved to a practical level by causing the transmissivities at the respective wavelengths described above to satisfy equations (1) to (3) below:

$$T_{450}/T_{530} = 1\text{–}2 \quad (1)$$
$$T_{615}/T_{530} = 1\text{–}2 \quad (2)$$
$$T_{450}/T_{615} = 0.7\text{–}1.43 \quad (3)$$

In the above equations, when a value calculated by equation (1) exceeds 2 or a value calculated by equation (3) exceeds 1.43, a bluish body color is undesirably obtained. When a value calculated by equation (2) exceeds 2 or a value calculated by equation (3) is smaller than 0.7, a reddish body color is undesirably obtained, resulting in an impractical application. In addition, when values calculated by equations (1) and (2) are smaller than 1, the contrast improvement is suppressed, and the BCP value is decreased, resulting in an impractical application.

When this optical filter is used, the BCP value falls within the range of 1.05 to 1.50, thus obtaining excellent contrast characteristics although this value is slightly changed depending on the emission spectrum of a phosphor used, a concentration of a filter material for the optical filter, and the like.

Figure 6:
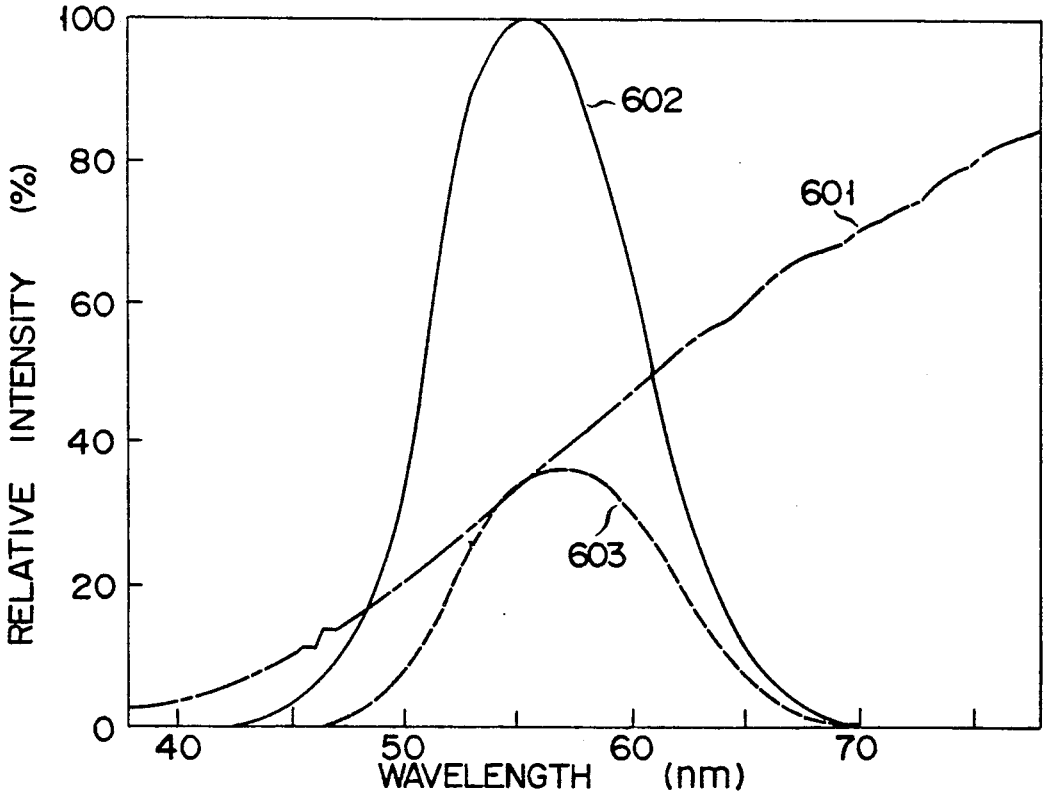
FIG. 6 is a graph showing a spectral distribution of light from an incandescent lamp.

When light from an incandescent lamp is replaced with ambient light, the body color of this optical filter, often becomes reddish. However, this can be corrected to such a degree that the optical filter can be practically applied. FIG. 6 is a graph showing a spectral distribution curve 601 representing a spectral distribution obtained when light from an incandescent lamp is replaced with ambient light, a spectral luminous efficacy curve 602, and a curve 603 representing the product of the spectral distribution curve 601 and the spectral luminous efficacy curve 602. As is apparent from the curve 601, light from the incandescent lamp has a higher relative intensity with an increase in wavelength. For this reason, the body color of the cathode ray tube having such a selective light-absorbing filter may often be reddish even in the cathode ray tube of the present invention. In this case, the transmissivity of the optical filter in the range of 650 to 700 nm providing a more reddish component can be smaller than that at 615 nm having a higher emission energy of a red emitting phosphor. Judging from this, the body color can be corrected without impairing the BCP improvement effect, thereby obtaining a cathode ray tube having a small body color change caused by ambient light.

As described above, since the optical filter used in the present invention has transmissivities satisfying a predetermined relationship, it can selectively absorb ambient light such as natural light or light from a fluorescent lamp. Red and blue color purity values of the image can be increased while a decrease in brightness is minimized.

Utilizing the above-described characteristics of the optical filter, the present inventors established a method of correcting color purity to obtain a satisfactory color tone without degrading the high brightness of the $Y_2O_3$:Eu phosphor by combining the $Y_2O_3$:Eu phosphor having a high brightness but unsatisfactory color purity and the optical filter under a condition for efficiently improving the color purity.

Figure 7:
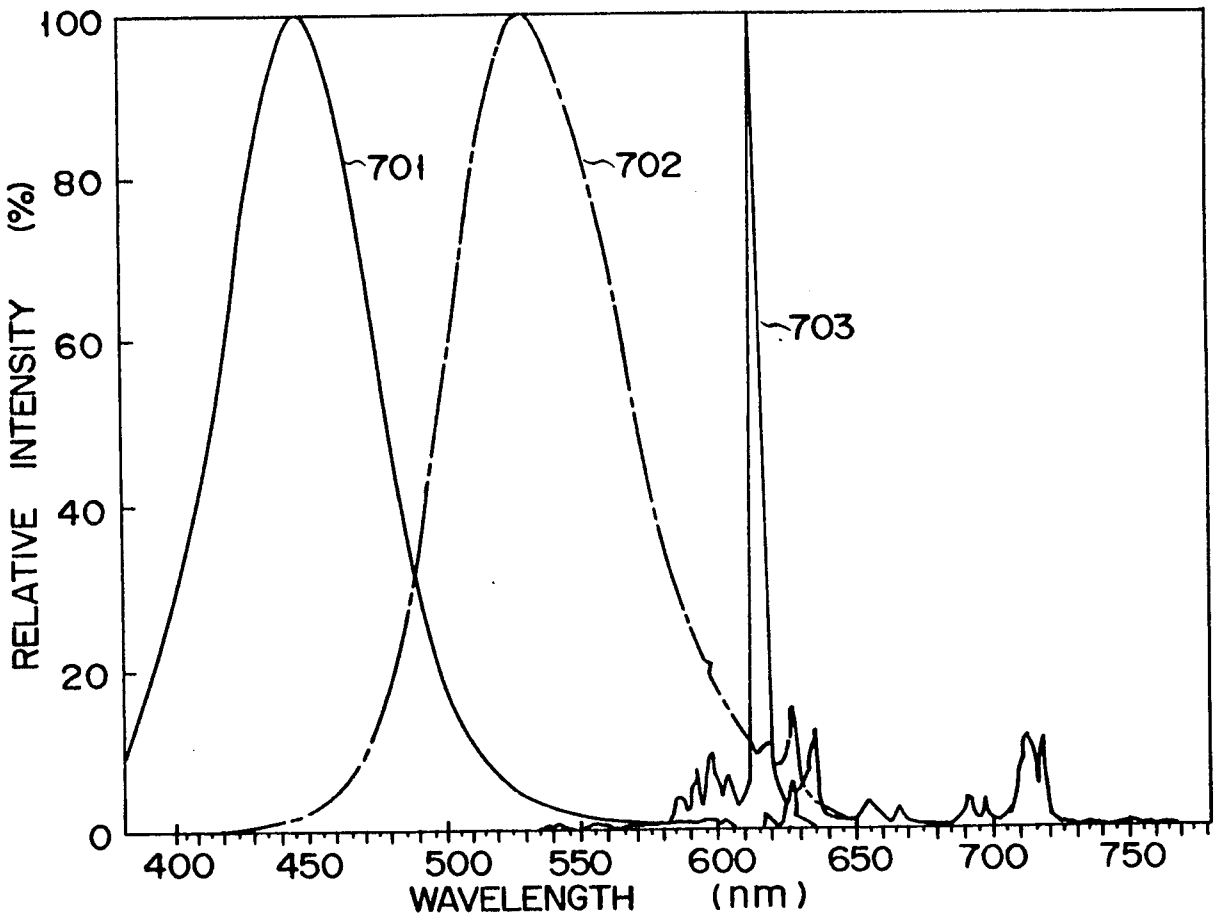
FIG. 7 is a graph showing spectral distributions of light components from a $Y_2O_3$:Eu red emitting phosphor, a general blue emitting phosphor, and a general green emitting phosphor.

FIG. 7 shows a curve 701 representing an emission spectrum of a typical blue emitting phosphor (ZnS:Ag,Cl phosphor), a curve 702 representing an emission spectrum of a green emitting phosphor (ZnS:Au,Al phosphor), and a curve 703 representing an emission spectrum of a red emitting phosphor ($Y_2O_3$:Eu phosphor). The present inventors found that the color purity could be improved by absorbing a larger amount of light corresponding to a short-wavelength subpeak, i.e., light in the range of 580 nm to 600 nm than an amount of light corresponding to the main peak (615 nm) of the $Y_2O_3$:Eu phosphor represented by the curve 703 in FIG. 7. The present inventors confirmed that when the transmissivity for 580 to 600 nm is given by a transmissivity for light of the maximum absorption wavelength in range of 615 nm as a characteristic of the optical filter used in the present invention satisfied the following condition:

$$T_{615}/T_{580\text{-}600} \geqq 1.1 \quad (4)$$

the chromaticity could be corrected in the same manner as in $Y_2O_3S$:Eu while the brightness was kept high. When a value satisfying condition (4) is smaller than 0.1, the color tone cannot be satisfactorily corrected.

An effect of the present invention can be obtained when an Eu activation amount falls within the range of 3.0 mol% (inclusive) to 9.0 mol% (inclusive) with respect to the base material, as will be described below.

Figure 8:
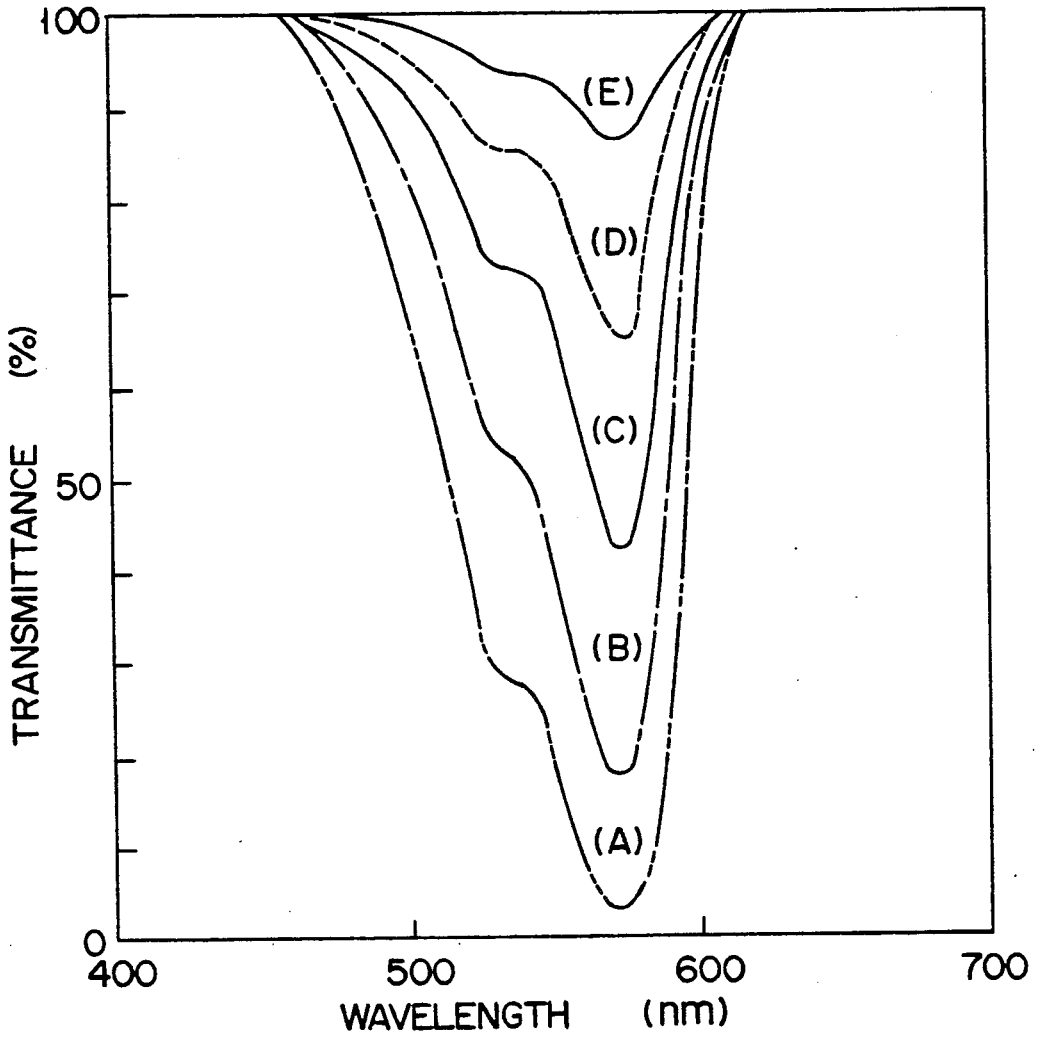
FIG. 8 is a graph showing selective light-absorbing characteristics of an optical filter used in the present invention.
Figure 9A:
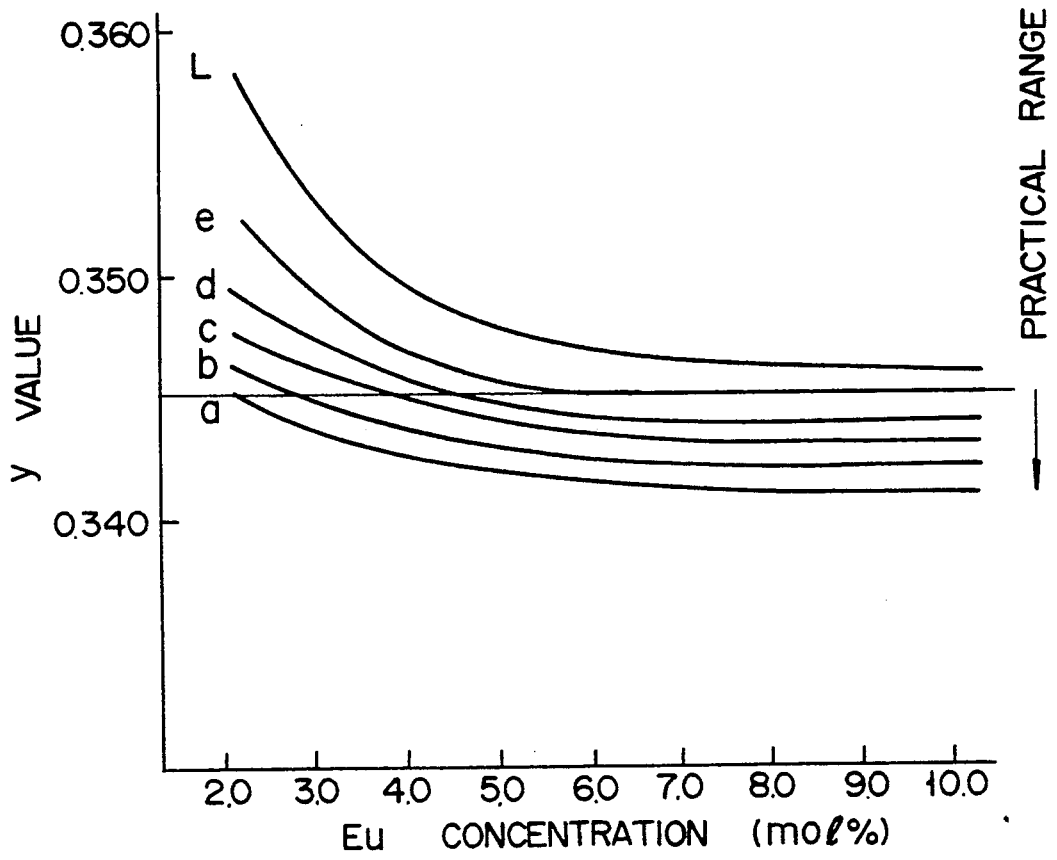
FIGS. 9A and 9B are graphs showing relationships between the chromaticity coordinate values and the Eu amounts of a cathode ray tube using the optical filter having the characteristics shown in FIG. 8, respectively.
Figure 9B:
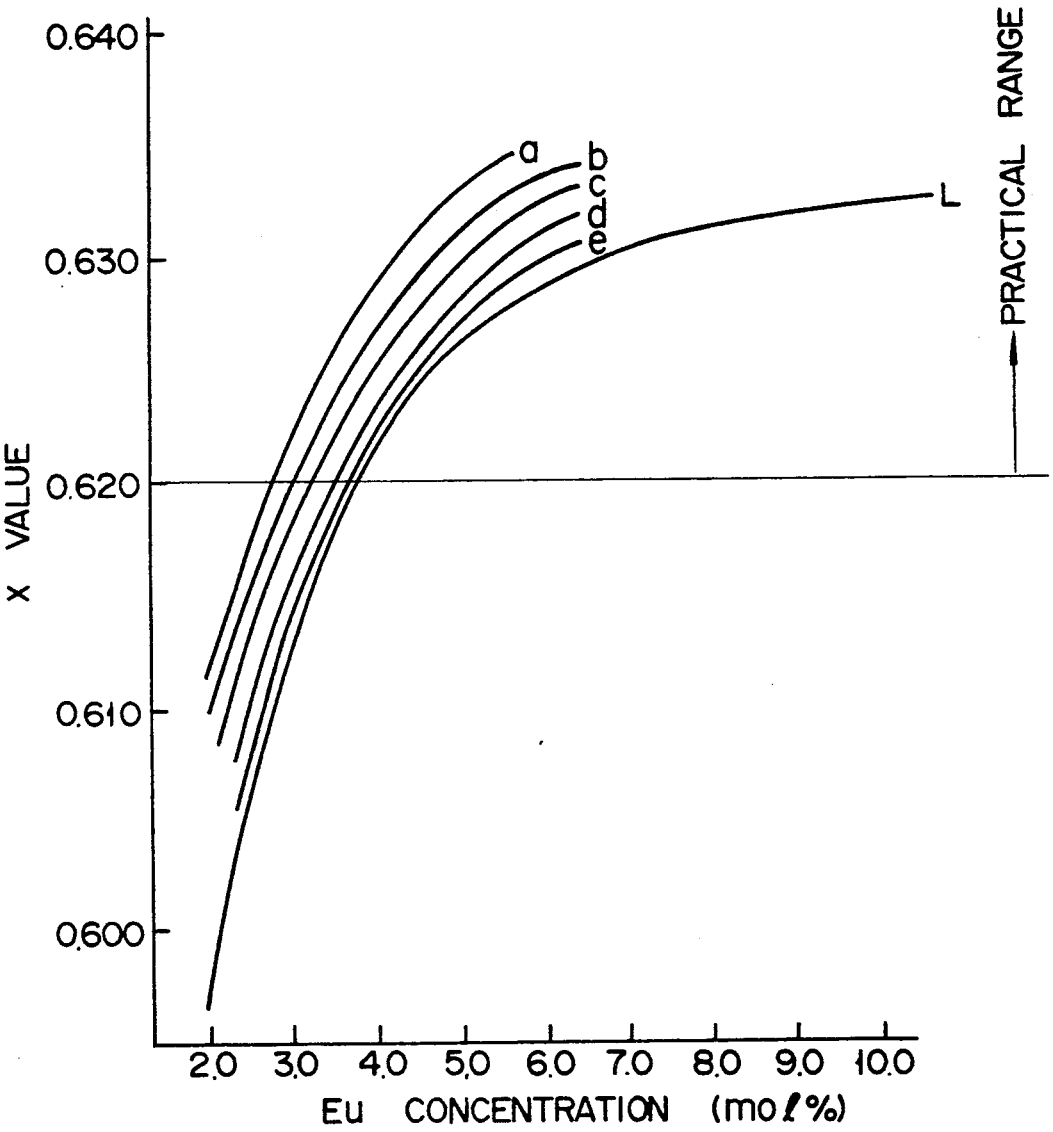

Color cathode ray tubes having Eu activation amounts of 3.0 mol%, 5.0 mol%, 7.0 mol%, 9.0 mol%, and 10.0 mol% were prepared, and optical filters A, B, C, D, and E having light-absorbing characteristics represented by curves A, B, C, D, and E in FIG. 8 were formed on the front surfaces of the faceplates, respectively. The chromaticity coordinate values of the resultant color cathode ray tubes were measured, and the relationships between the chromaticity coordinate values and the Eu activation amounts, as shown in FIGS. 9*a* and 9*b*, were obtained. Curves L, a, b, c, d, and e respectively show CIE chromaticity values (y and x values) obtained when a filter is not used, the filter A is used, the filter B is used, the filter C is used, the filter D is used, and the filter E is used. A hatched region ($y \leqq 0.345$ and $x \geqq 0.620$) represents a practical region of $Y_2O_2S$:Eu.

As shown in FIGS. 9*a* and 9*b*, when the Eu activation amount is increased, a change in chromaticity is reduced. The chromaticity coordinate values cannot fall within the hatched region without filters. According to the present invention, expensive Eu need not be used in a large amount. The Eu activation amount preferably falls within the range of 3.0 to 5.5 mol%.

The body color was evaluated as follows.

The body color was evaluated by a human visual sense in accordance with whether an observer can recognize displayed black as natural black without adding any other color tone to black when a black image is displayed on each color cathode ray tube. More specifically, a 50 mm×50 mm black pattern was displayed at a central portion of each cathode ray tube, and a background of this pattern was displayed in white. The faceplate was illuminated with an incandescent lamp obliquely at a 45° position from the faceplate surface so as to obtain a brightness of 500 luxes. Under these conditions, the tone colors (red, blue, green and the like) of black portions were evaluated. When the black image is observed as black without any other color tone, this result is evaluated as ◎. When the black image is observed as black with some color tones, which does not pose any practical problem, the result is evaluated as o. When the black image is observed as black with relatively strong tone colors except for the black tone color, which poses a practical problem, the result is evaluated as Δ. When the black image cannot be observed as black due to strong color tones, the result is evaluated as x. Test result are summarized as follows:

TABLE 1

| | A | B | C | D | E | Glass with $Nd_2O_3$ |
|---|---|---|---|---|---|---|
| BCP | 1.70 | 1.47 | 1.25 | 1.14 | 1.06 | 1.02 |
| Body Color | x (red) | ○ | ○ | ◎ | ◎ | x (red) |

When the Eu activation amount is 3.0 mol%, the chromaticity coordinate values fall within the hatched region by using the filter B. As shown in Table 1, the body color of the filter B is evaluated as o and presents no problem. However, when the Eu activation amount is less than 3.0 mol%, the chromaticity coordinate values cannot fall within the hatched region even if the filter B is used. Even if chromaticity adjustment is performed by using the filter A or a filter having a higher density, the body color of the filter A becomes strongly reddish, thus posing a practical problem. At this time, when the density of the filter is increased, the above tendency is accelerated, resulting in an impractical application. Therefore, the Eu activation amount is preferably 3.0 mol% or more to obtain a better effect. When the Eu activation amount is 5.5 mol%, the chromaticity coordinate values fall within the hatched region by using the filter E, as shown in FIG. 9*a*. It is therefore found that an optical filter to be used in the present invention must have a chromaticity correction capacity equal to or higher than that of the filter E. The chromaticity correction capacity is determined depending on whether the subpeak components, i.e., yellow components near 580 nm to 600 nm are absorbed more than the main peak components in $Y_2O_3$:Eu. When the filter E is used, $T_{615}/T_{580\text{-}600}=1.1$ is given. When a value satisfying condition (4) is less than 1.1, $Y_2O_3$:Eu cannot be corrected to the practical range of $Y_2O_2S$:Eu.

Figure 11:
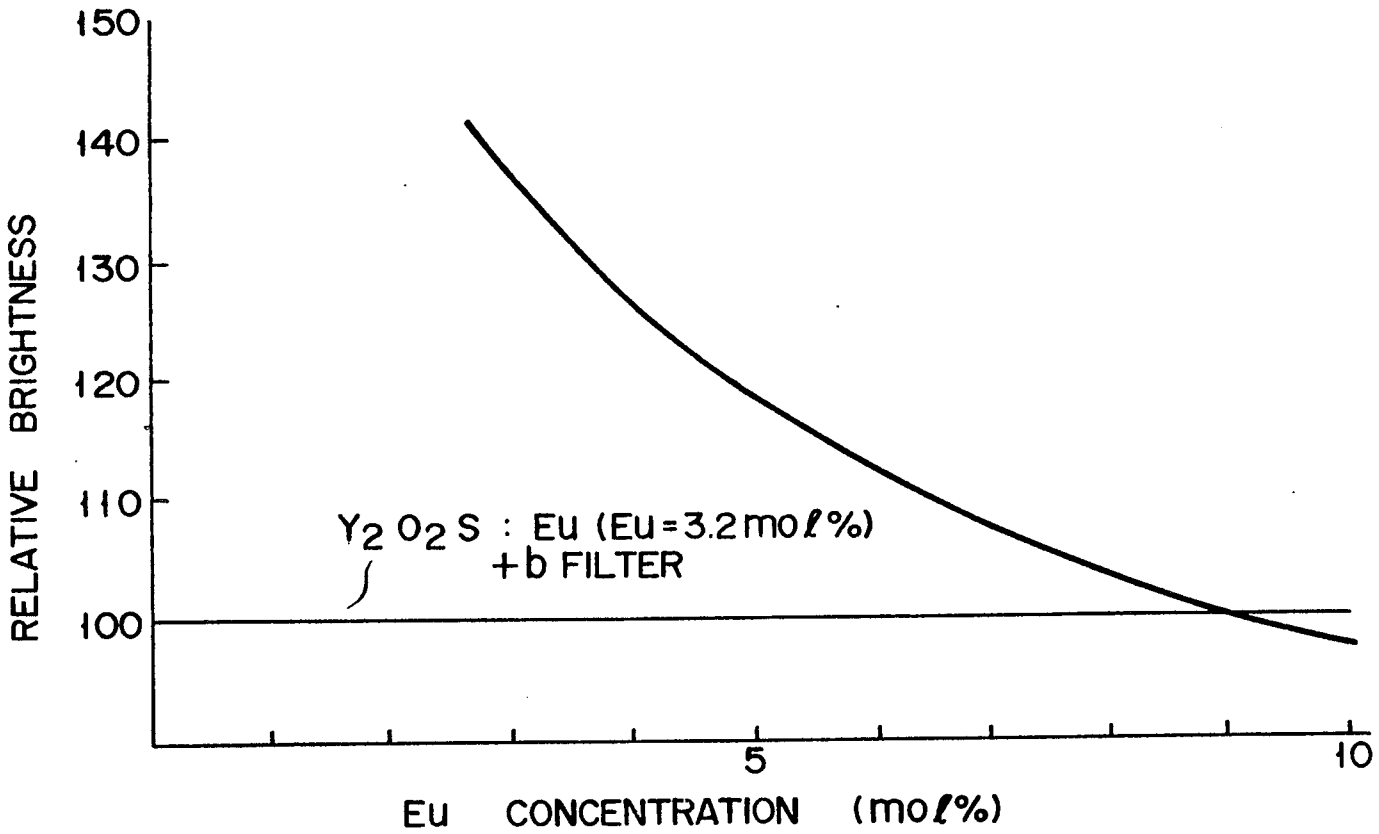
FIG. 11 is a graph showing brightness comparison between the present invention and $Y_2O_2S$:Eu.

When the Eu concentration is increased, the brightness is decreased in $Y_2O_3$:Eu. When the Eu concentration is increased or decreased, the color purity and brightness of the $Y_2O_2S$:Eu phosphor similarly change. More specifically, when the Eu concentration is decreased, the color purity value is decreased, while the brightness is improved. An Eu amount required to satisfy color purity to fall within the range of $x \geqq 0.620$ and $y \geqq 0.345$ by using $Y_2O_2S$:Eu and the filter B was 3.2 mol%. The corresponding chromaticity coordinates were given as (x, y)=(0.623, 0.345). FIG. 11 shows a curve obtained by changing the Eu concentration of $Y_2O_3$:Eu and comparing the brightness values when $Y_2O_2S$:Eu was Eu=3.2 mol% and the filter B was used. When the Eu concentrations were 3.0 and 3.5 mol%, the filter B was used. When the Eu concentration was 4.0 mol%, the filter C was used. When the Eu concentrations were 4.5 and 5.0 mol%, the filter D was used. When the Eu concentration was 5.5 mol% or more, the filter E was used.

As is apparent from the graph in FIG. 11, when the Eu concentration is 9 mol% or more, the brightness is impaired to an impractical value. Therefore, the Eu concentration is preferably less than 9 mol%. Therefore, the Eu concentration falls within the range of 3.0 mol% (inclusive) to 9 mol% (inclusive).

According to the present invention, an optical filter satisfying equations (1) to (3) and condition (4) is combined with a $Y_2O_3$:Eu phosphor having an Eu activation amount of 3.0 mol% (inclusive) to 0.9 mol% (inclusive) to efficiently obtain a low-cost color cathode ray tube which causes less changes in body color upon changes in ambient light and has excellent red pixels, a high contrast level, a high brightness level, and a high color purity level.

A cathode ray tube according to the present invention is prepared as follows. Appropriate dyes and pigments which can provide the selective light-transmitting property described above are mixed in an alcohol solution containing ethyl silicate as a major constituent. The resultant mixture is directly applied to the faceplate by spin coating or spray coating to form an optical filter layer. Alternatively, dyes and pigments could be mixed in an acrylic resin or the like to prepare a filter plate, and this filter plate is mounted on the faceplate of the cathode ray tube. In the case of a "telepanel" type cathode ray tube, these dyes may be mixed in an adhesive resin used for adhering this telepanel serving as a color filter to the faceplate.

Examples of the dye used for such an optical filter are acid rhodamine B, rhodamine B, and KAYANAL-MILLING RED 6B (tradename) available from NIPPON KAYAKU CO., LTD. Examples of the dye added to correct a body color are KAYASET BLUE K-FL having a peak at 675 nm, and a nearinfrared absorbent. In addition, an organic pigment above, or an inorganic pigment such as a mixture of cobalt aluminate and cadmium red can be used.

An example of the blue emitting phosphor used in the cathode ray tube of the present invention is ZnS:Ag,Cl, and an example of the red emitting phosphor is $Y_2O_3$:Eu.

EXAMPLE 1

Green pixels consisting of a ZnS:Cu,Al phosphor, blue pixels consisting of a ZnS:Ag,Al phosphor, and red pixels consisting of a $Y_2O_3$:Eu phosphor having an Eu activation amount of 3.5 mol% with respect to the base material were used to form an emission screen on the inner surface of a faceplate by a known photographic printing method, and a color cathode ray tube was assembled with the emission screen. An alcohol coating solution having the following composition was prepared.

| | |
|---|---|
| Ethyl Silicate ($Si(OC_2H_5)_4$) | 7 g |
| Hydrochloric Acid (HCl) | 3 g |
| Water | 2 g |
| Isoproplylalcohol | 84–87.7 g |
| Acid Rhodamine B | 1 g |

Figure 10:
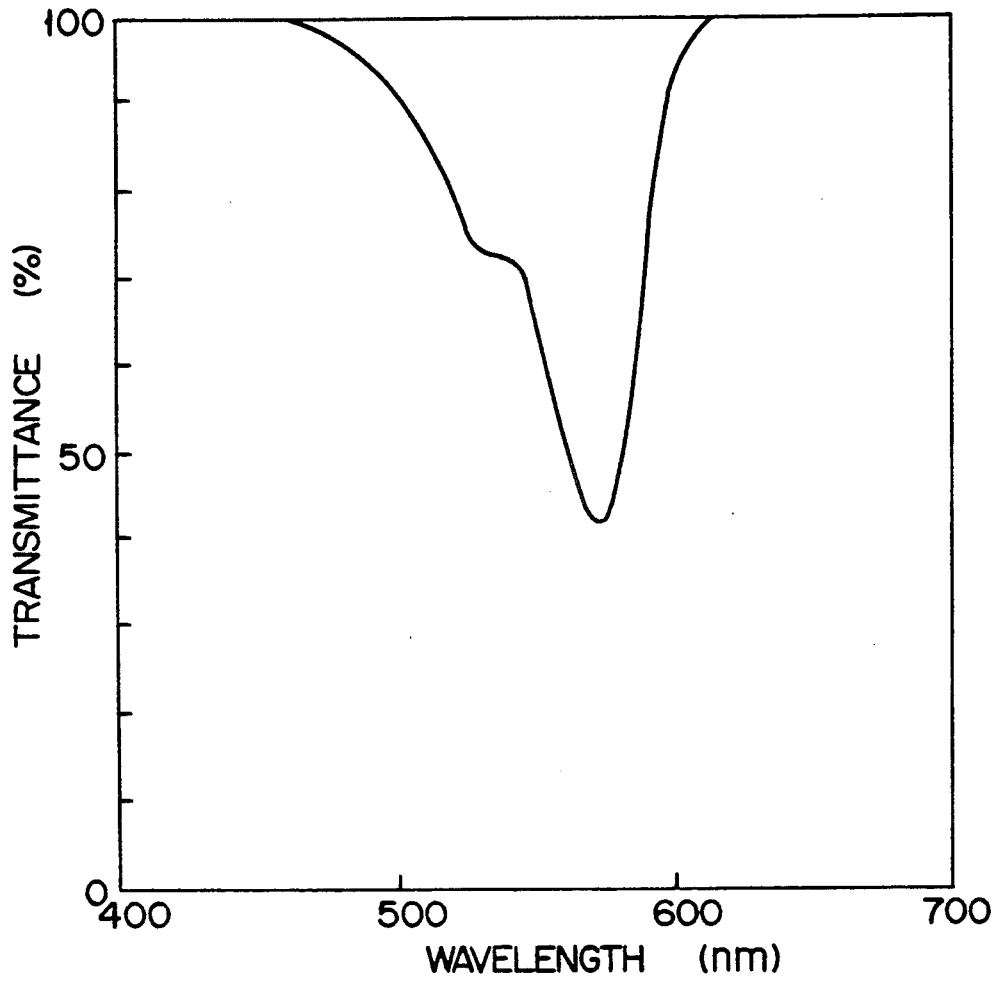
FIG. 10 is a graph showing light-absorbing characteristics of an optical filter according to a embodiment of the present invention.

The resultant solution was applied to the front surface of the faceplate of the above color cathode ray tube by spin coating and was dried to form an optical filter layer. The transmissivity of this optical filter layer is shown in FIG. 10. An image displayed on this color cathode ray tube was evaluated. The red emission brightness level was increased by 50% as compared with a color cathode ray tube using $Y_2O_2S$:Eu with an Eu activation amount of 4.5 mol% with respect to the base material. The chromaticity coordinate values fell within the practical range of the $Y_2O_2S$:Eu phosphor. $T_{580\text{-}600}=45\%$, and $T_{615}=98\%$, thus satisfying condition $T_{615}/T_{580\text{-}600} \geqq 1.1$. In addition absorption peak appeared at 575 nm; $T_{min}=42\%$, $T_{450}=100\%$; $T_{530}=72\%$; $T_{550}=68\%$; and $T_{615}=98\%$. The test results satisfy the following conditions:

$$T_{min} \leqq T_{550} \leqq T_{530}$$
$$1 \leqq T_{450}/T_{530} \leqq 2$$
$$1 \leqq T_{615}/T_{530} \leqq 2$$
$$0.7 \leqq T_{450}/T_{615} \leqq 1.43$$

The BCP value was 1.25, thus providing a sufficiently high contrast level.

In Example 1, the optical filter layer is formed on the front surface of the faceplate of the normal cathode ray tube. However, in a "telepanel" cathode ray tube on which a telepanel serving as a color filter is mounted on the front surface of its faceplate, even if a dye such as acid rhodamine B was mixed in an adhesive resin for mounting the telepanel, the same effect as in Example 1 was obtained.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims and their equivalents.

What is claimed is:

1. A color cathode ray tube comprising:

an envelope including a faceplate with an inner and outer surface, a side wall portion, a neck and a cone connecting the faceplate to the neck;

an electron gun provided inside the neck for emitting at least one electron beam;

a phosphor screen provided on the inner surface of the faceplate having red, blue, and green emitting phoshor, the red emitting phosphor comprising a $Y_2O_3$:Eu phosphor with an Eu amount between 3.0 mol% and 9.0 mol% inclusive with respect to a $Y_2O_3$ amount as a base material; and light filtering means provided in front of the faceplate for selectively transmitting light, said light filtering means having a maximum absorption wavelength of 575±20 nm in a wavelength range from 400 nm to 650 nm and satisfying the following relationship:

$$T_{min} < T_{550} \leqq T_{530}$$
$$1 \leqq T_{450}/T_{530} \leqq 2$$
$$1 \leqq T_{615}/T_{530} \leqq 2$$
$$0.7 \leqq T_{450}/T_{615} \leqq 1.43$$
$$T_{651}/T_{580\text{-}600} \leqq 1.1$$

wherein $T_{450}$, $T_{530}$, $T_{550}$, $T_{615}$, $T_{min}$ and $T_{580\text{-}600}$ represent the transmissivities for light of wavelengths of 450 nm, 530 nm, 550 nm, 615 nm, the maximum absorption wavelength of 575±20 nm and the maximum absorption wavelength in a wavelength range of 580 to 6000 nm, respectively.

2. A cathode ray tube according to claim 1, wherein the Eu amount of the $Y_2O_3$:Eu phosphor is not less than 3.0 mol% and not more than 5.5 mol% with respect to the amount of the base material.

3. A cathode ray tube according to claim 1, wherein the light filtering means contains $SiO_2$ as a major constituent and a colorant.

4. A cathode ray tube according to claim 1, wherein the light filtering means contains an acrylic resin as a major constituent and a colorant.

5. A cathode ray tube according to claim 3, wherein the colorant is at least one material selected from the group consisting of a dye, an organic pigment, and an inorganic pigment.

6. A cathode ray tube according to claim 3, wherein the colorant is at least one dye selected from the group consisting of acid rhodamine B and rhodamine B.

7. A cathode ray tube according to claim 4, wherein the colorant is an inorganic pigment comprising a mixture of cobalt aluminate and cadmium red.

8. A cathode ray tube according to claim 1, wherein the light filtering means comprises a glass layer formed by using a metal alcoholate containing Si.

* * * * *